US006219433B1

(12) United States Patent
Okuzawa et al.

(10) Patent No.: US 6,219,433 B1
(45) Date of Patent: Apr. 17, 2001

(54) WAX, COPPER FOIL FLEXIBLE WIRE WITH WAX AND SPEAKERS USING THIS FLEXIBLE WIRE

(75) Inventors: Kazuro Okuzawa, Tsu; Tamie Oyanagi, Osaka, both of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/537,548

(22) Filed: Mar. 30, 2000

Related U.S. Application Data

(62) Division of application No. 08/933,081, filed on Sep. 18, 1997.

(30) Foreign Application Priority Data

Sep. 27, 1996 (JP) ..... 8-255221

(51) Int. Cl.[7] ..... H04R 25/00
(52) U.S. Cl. ..... 381/410; 381/400; 427/443
(58) Field of Search ..... 381/400, 410; 106/18.18, 18.16, 18.29; 252/601; 554/1; 585/946; 429/921; 427/393.3, 117, 434.6, 443

(56) References Cited

U.S. PATENT DOCUMENTS

| | | | | |
|---|---|---|---|---|
| 2,657,758 | * | 11/1953 | Varnet | 381/410 |
| 5,602,931 | | 2/1997 | Geisenberger . | |
| 6,115,479 | * | 9/2000 | Okuzawa et al. | 381/410 |

FOREIGN PATENT DOCUMENTS

| | | |
|---|---|---|
| 58-75708 | 5/1983 | (JP) . |
| 363224595 | 9/1988 | (JP) . |
| 407207263 | 1/1994 | (JP) . |

* cited by examiner

*Primary Examiner*—Curtis A. Kuntz
*Assistant Examiner*—Suhan Ni
(74) *Attorney, Agent, or Firm*—Parkhurst & Wendel, L.L.P.

(57) ABSTRACT

This invention is intended to provide a wax excellent as a surface treating agent, a copper foil flexible wire capable of accommodating with flame resistance, and a speaker using this flexible wire. It is characterized in that petroleum wax is mixed with 50 wt %–150 wt % of liquid phosphoric ester flame retardant. In case of forming this flexible wire constituted by a plurality of core wires (8), each of which is wound by copper foil (9) and braided together or stranded, and then impregnated with the wax in order to form a wax layer (10), it realizes to provide a highly flame resistant flexible wire which satisfies the UL Standards 94V-2 or higher level without degrating its flexibility.

3 Claims, 2 Drawing Sheets

WAX, COPPER FOIL FLEXIBLE WIRE WITH WAX AND SPEAKERS USING THIS FLEXIBLE WIRE

This is a Division of application Ser. No. 08/933,081 filed Sep. 18, 1997.

FIELD OF THE INVENTION

The invention relates to wax used as a surface treating agent, a copper foil flexible wire impregnated with the wax and speakers using this flexible wire.

BACKGROUND OF THE INVENTION

A speaker is constructed as shown in FIG. 2.

A magnetic circuit 1 is composed of a lower plate 1*a* having a center pole section, a magnet 1*b* and an upper plate 1*c*. A frame 2 is mounted on the upper side of the magnetic circuit 1. An outer rim of the diaphragm 3 is connected to the inner rim of the frame 2, and the inner rim of the diaphragm 3 is connected to a voice coil bobbin 4 inserted into a magnetic gap 1*d* of the magnetic circuit 1.

The frame 2 has a lead out terminal 5. The voice coil bobbin 4 is wound up with a voice coil 6. The lead out terminal 5 is electrically connected to the voice coil 6 by the copper foil flexible wire 7.

As shown in FIG. 3, the copper foil flexible wire 7 is constituted of braiding or stranding a plurality of core wires 8, each of which is wound by copper foil 9. Although there are some other constitutions of the flexible wire, it is generally called a gold wire or glorious wire.

The speaker generates sounds by inputting sound signals to the lead out terminal 5 in order to drive the voice coil bobbin 4 and thus to vibrate the diaphragm 3.

Recently in a tendency to increase the input capacity to a speaker, there have been disadvantages when using the copper foil flexible wire 7. It vibrates by the vibration of diaphragm 3, which is called a hopping phenomenon. This phenomenon results, in noise being generated when the copper foil flexible wire 7 collides with diaphragm 3. The copper foil of the flexible wire 7 may break in an extreme case.

In order to overcome these disadvantages, some types of copper foil flexible wire 7 are impregnated with wax. However, this type of flexible wire 7 must be flame resistant against the rise of temperature itself, when the input capacity to the speaker is increased.

It is an object of the present invention to provide wax which is excellent as a surface treating agent, a copper foil flexible wire treated to be flame resistant, and a speaker using this flexible wire.

DISCLOSURE OF THE INVENTION

Wax according to the present invention comprises petroleum as a base, which is mixed with a liquid phosphoric ester flame retardant, and can realize a flame resistant wire such as the copper foil flexible wire without degrading its flexibility.

Wax according to an embodiment of the present invention is characterized in that the petroleum wax as a base is mixed with 50 wt %–150 wt % of liquid phosphoric ester flame retardant, and it can realize the highly flame resistant copper foil wire which satisfies the UL Standards 94V-2 (Standards of Underwriter Laboratory of the United States) or higher levels without degrading its flexibility when the copper foil wire is impregnated with the wax.

Wax according to a second embodiment comprises petroleum wax as a base, wherein it is mixed with a bromine type incombustible which is containing flame retardant accounting for 50 wt %–150 wt % of the wax with a melting point of 70° C.–140° C. and a decomposition point of 250° C. or above; cyclic saturated hydrocarbon accounting for 5 wt %–50 wt % of for the wax with a melting point of 70° C.–140° C.; and an inorganic flame retardant accounting for 1 wt %–10 wt % of the wax; and an organic compound as a stabilizer accounting for 0.5 wt %–5 wt % of the wax. It can realize the highly flame resistant copper foil wire which satisfies the UL Standards 94V-2 or higher level without degrading its flexibility when the copper foil wire is impregnated with the wax.

A copper foil flexible wire for a speaker according to an embodiment is characterized in that the wire is constituted by a plurality of core wires, each of which is wound by copper foil being braided together or stranded, impregnated with the wax of the above mentioned embodiments. It can realize the highly flame resistant copper foil wire which satisfies the UL Standards 94V-2 or higher level without degrading its flexibility.

A speaker according to another embodiment is characterized in that the copper foil flexible wire which electrically connects the lead out terminal mounted on the frame to the voice coil wound around the voice coil bobbin is constituted by a plurality of core wires wound by copper foil being braided together or stranded, and is impregnated with the wax according the above mentioned embodiments. A highly flame resistant speaker with a highly flame resistant copper foil flexible wire can be realized.

DESCRIPTION OF THE EMBODIMENTS

Embodiment 1

Figure 3:
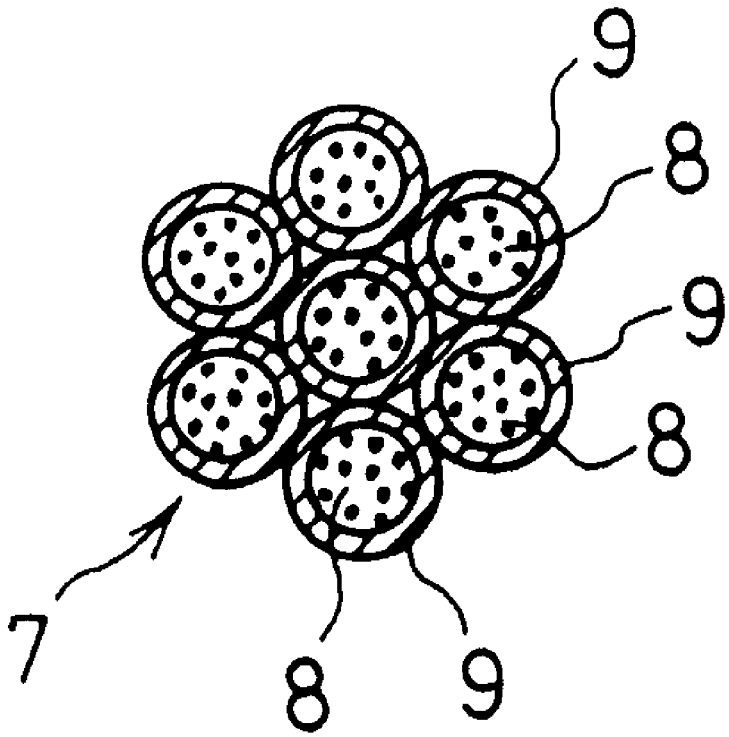
FIG. 3 PRIOR ART
FIG. 3 is a sectional view of a prior art copper foil flexible wire.

As illustrated in FIG. 3, a cotton yarn or a chemical fiber with heat resistance (a yarn of aromatic polyamide, aramid fiber, etc.) which is used as core fiber 8 is wound by copper foil 9 to form a single wire, and a plurality of the single wires are braided together or stranded to make the copper foil flexible wire 7. This flexible wire 7 is the same as a prior copper foil flexible wire.

Figure 1:
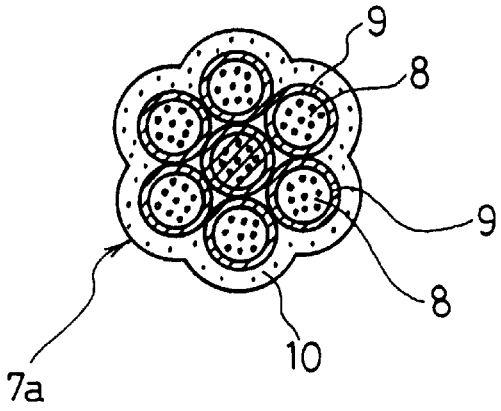
FIG. 1 is a sectional view of a copper foil flexible wire of the present invention.
Figure 2:
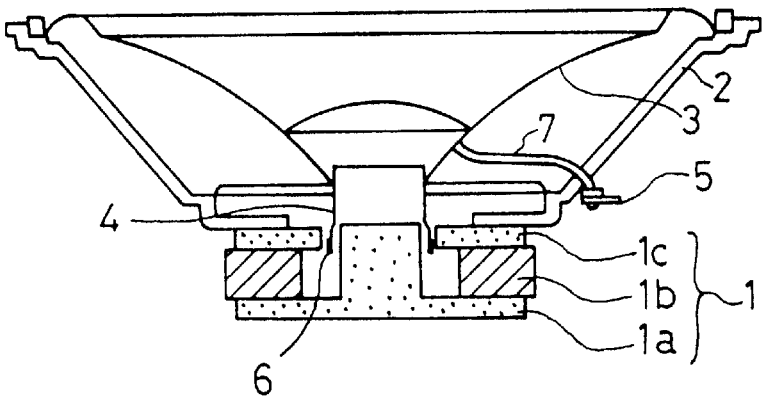
FIG. 2 PRIOR ART
FIG. 2 is a sectional view of a prior art speaker.

Then wax A, wax B and wax C were prepared as listed in Table 1. The copper foil flexible wire 7 was immersed in each molten wax respectively, and wax 10 was formed on the surface as shown in FIG. 1 to prepare copper foil flexible wire 7*a* impregnated with wax 10.

More specifically, petroleum wax as a base (trade name: Microwax 190 Y, Mobil Petroleum Co.) with a melting point of about 90° C. was molten at 190° C., and mixed with a phosphoric ester flame retardant (triaryl phosphoric ester . . . Leophorse 65 . . . Ajinomoto Co.) with a decomposition point of 200° C. or higher as listed in Table 1 to prepare flame resistant waxes A, B and C.

The copper foil flexible wire 7 was immersed in each of the waxes. When the wire was picked up from the wax, it was passed through a die to adhere the flame resistant wax uniformly on the surface of this flexible wire.

Then, instead of prior art copper foil flexible wire 7, each of the flexible wire 7*a* impregnated with wax was used for making a speaker having 16 cm in diameter. As a reference, a flexible wire 7 without wax was used for a speaker having 16 cm in diameter.

Further, bending strength, corrosion resistance, soldering property and flame resistance were tested on the copper foil flexible wires 7 and 7*a*. These results are listed in Table 1. In Table 1, test results for the prior flexible wire 7 without wax are also listed as a reference.

"Corrosion resistance-1 of copper foil flexible wire" was determined after exposing the flexible wires to the 85° C. atmosphere for 500 hours, and "Corrosion resistance-2 of copper foil flexible wire" was determined after exposing the flexible wires to the 55° C. and 95% RH of atmosphere for 1,000 hours.

Bending strength of gold wire is defined as the time of bending when its conductivity is lost. Soldering property-1 of the gold wire was determined after exposing the wire to the 85° C. of atmosphere for 500 hours, and soldering property-2 of the gold wire was determined after exposing the wire to the 55° C. and 95% RH atmosphere for 1,000 hours.

Then, the hopping phenomenon of a speaker caused at each of the input times was confirmed. The results are shown in Table 2.

According to the above described results, it was confirmed that the copper foil flexible wires with waxes A, B and C exhibited surpassing property on bending strength, corrosion resistance and soldering property, with sufficient flame resistance. The hopping phenomenon was also confirmed to be more suppressed than in the prior material.

When the phosphoric ester flame retardant is less than 50%, 40% for example, the flame resistance becomes insufficient, and when the phosphoric ester flame retardant is more than 150%, the mixing condition with the petroleum wax becomes worse. This causes nonuniform product quality and therefore is not preferable for the copper foil flexible wire.

Embodiment 2

As illustrated in FIG. 3, a cotton yarn or a chemical fiber with heat resistance (yarn of aromatic polyamide, aramid fiber, etc.) which is used as core fiber 8 is wound by copper foil 9 to form a single wire, and a plurality of the single wires are braided together or stranded to make the copper foil flexible wire 7. This flexible wire 7 is the same as a prior art copper foil flexible wire.

Then wax D, wax E and wax F were prepared as listed in Table 3. The copper foil flexible wire 7 was immersed in each of the molten wax respectively, and wax 10 was formed on the surface as described in FIG. 1 to make copper foil flexible wire 7*a* impregnated with wax 10.

More specifically, the petroleum wax as a base (product name: Microwax 190 Y, Mobil Petroleum Co.) having about 90° C. of melting point was molten at 190° C., and mixed with a bromine-containing flame retardant (brominated aromatic compound (aromatic triazin)) having about 250° C. of decomposition point, an inorganic flame retardant (antymony trioxide), synthetic resin composed of cyclic saturated hydrocarbon (terpene-denatured phenol resin) having 135° C. of melting point and organic tin compounds as a stabilizer, as listed in Table 3 to prepare flame resistant waxes D, E and F. The copper foil flexible wire 7 was immersed in each of the wax. When the wire was picked up from the wax, it was passed through a die to form the flame resistant wax uniformly on the surface of this flexible wire which resulted in the flexible wire with wax 7*a*.

Then, each of the flexible wire 7*a* with wax was used for making a speaker, described in a prior art, having 16 cm in diameter. As a reference, a flexible wire 7 without wax was used for a speaker having 16 cm in diameter. Further, bending strength, corrosion resistance, soldering property and incombustibility were tested on the copper foil flexible wire. These results are listed in Table 3. In Table 3, test results for a prior flexible wire without wax are also listed as a reference.

Corrosion resistance was determined after exposing the flexible wire to the 55° C. and 95% RH atmosphere for 500 hours. Bending strength of the flexible wire was defined as the time of bending when its conductivity was lost. Soldering property was determined after exposing the wire to the 55° C. and 95% RH atmosphere for 500 hours.

Then, the hopping phenomenon of a speaker caused at each of the input times was confirmed. The results are listed in Table 4.

According to the above described results, it was confirmed that the copper foil flexible wire 7*a* with waxes D, E and F exhibited surpassing property on bending strength, corrosion resistance and soldering property, with sufficient flame resistance. Also, the hopping phenomenon was also confirmed to be more suppressed than in the prior material.

When the bromine containing flame retardant is less than 50 wt % (of the wax as a base), flame resistance becomes insufficient. And when it is more than 150 wt %, impregnation to the flexible wire by immersion becomes hard, so that it is not preferable to use either of them.

When the inorganic flame retardant is less than 1 wt % (of the wax as a base), flame resistance becomes insufficient. And when it is more than 10 wt %, impregnation to the flexible wire by immersion becomes hard, so that it is not preferable to use either of them.

When the organic compound as a stabilizer is less than 0.5 wt % (of the wax as a base), corrosion of copper foil flexible wire is stimulated. And when it is more than 10 wt %, the mixing condition with the petroleum wax becomes insufficient causing precipitation in spite of having corrosion resistance. This phenomenon may result in a rise in melting point of wax and the difficulty of impregnation by immersion so that it is not preferable to use practically.

When the synthetic resin composed of cyclic saturated hydrocarbon is less than 5 wt % (of the wax as a base), it never contributes to the improvement in rigidity of the copper foil flexible wire for speaker. And when it is more than 50 wt %, the flexibility of the copper foil flexible wire may be decreased, so that the wire tends to be broken. This is not preferable to use practically.

While the invention has been described in detail in respect to the preferred embodiments in which the copper foil flexible wire is a conductive wire with flexibility composed of fibers, which is sometimes called a glorious wire or a gold wire due to its production process, it is proper to intend that each of them is completely included within the scope of the present invention.

Although each of the above embodiments has explained about the wax for use for the copper foil flexible wire, good results can be also obtained in case of using it for other materials requiring a wet proof property, corrosion resistance, etc. More concretely, it is expected to use the wax for a wallpaper of house or a waterproof sheet with the improvement of a wet proof property and the corrosion resistance without losing its flexibility.

TABLE 1

| Item | | Unit | Prior material (1) | Wax A | Wax B | Wax C |
|---|---|---|---|---|---|---|
| Wax | | part | 0 | 100 | 100 | 100 |
| Phosphoric ester flame retardant | | part | | 50 | 100 | 150 |
| Melting point of mixed wax | | ° C. | — | 88 | 87 | 86 |
| Copper foil wire: | bending strength | times | 16000–18000 | 21000–23000 | 21000 – 23000 | 22000–24000 |
| Copper foil wire: | corrosive resistance-1 | | corrosive | good | good | good |
| | corrosive resistance-2 | | corrosive | good | good | good |
| | soldering property-1 | | no good | good | good | good |
| | soldering property-2 | | no good | good | good | good |
| | flame resistance UL-94 | | V-1 level | V-2 level | V-2 level | V-1 level |

TABLE 2

| Input power | Prior material | Wax A | Wax B | Wax C |
|---|---|---|---|---|
| 10W | ○ | ○ | ○ | ○ |
| 20W | ○ | ○ | ○ | ○ |
| 30W | ○ | ○ | ○ | ○ |
| 40W | ○ | ○ | ○ | ○ |
| 50W | X | ○ | ○ | ○ |
| 60W | | X | X | X |

TABLE 4

| Input power | Prior material | Wax D | Wax E | Wax F |
|---|---|---|---|---|
| 10w | ○ | ○ | ○ | ○ |
| 20W | ○ | ○ | ○ | ○ |
| 30W | ○ | ○ | ○ | ○ |
| 40W | ○ | ○ | ○ | ○ |
| 50W | X | ○ | ○ | ○ |
| 60W | | X | X | X |

TABLE 3

| Item | Unit | Prior material(1) | Wax D | Wax E | Wax F |
|---|---|---|---|---|---|
| Wax | part | 0 | 100 | 100 | 100 |
| Flame retardant: halogen | part | | 50 | 100 | 150 |
| Flame retardant: inorganic part | part | | 5 | 5 | 5 |
| Synthetic resin | part | | 5 | 5 | 5 |
| Stabilizer | part | | 2 | 2 | 2 |
| Melting point of mixed wax | ° C. | — | 92 | 95 | 98 |
| Copper foil flexible: | times | 16000– | 20000– | 20000– | 20000– |
| bending strength | | 18000 | 22000 | 22000 | 22000 |
| corrosive resistance | | corrosive | good | good | good |
| soldering property | | little bad | good | good | good |
| flame resistance UL-94 | | V-1 level | V-2 level | V-2 level | V-1 level |

What is claimed is:

1. Wax comprising by mixing:

petroleum wax as a base;

a bromine-containing flame retardant accounting for 50 wt %–150 wt % of the wax with a melting point of 70° C.–140° C. and a decomposition point of 250° C. or higher;

cyclic saturated hydrocarbon accounting for 5 wt %–50 wt % of the wax with a melting point of 70° C.–140° C.;

an inorganic flame retardant accounting for 1 wt %–10 wt % of the wax; and an organic tin compound as a stabilizer accounting for 0.5 wt %–5 wt % of the wax.

2. Copper foil flexible wire for speakers, characterized in that the wire is constituted by plural core wires, each of which is wound by copper foil and braided together or stranded, and impregnated with the wax according to claim 1.

3. A speaker comprising:

a magnetic circuit;

a frame mounted on the upper part of the magnetic circuit;

a diaphragm in which the outer rim is connected to the inner rim of the frame and the inner rim is connected to a voice coil bobbin inserted into a magnetic gap of the magnetic circuit;

a lead out terminal mounted on the said frame;

a voice coil winding around the voice coil bobbin; and a copper foil flexible wire of which one end is connected to the end of the voice coil and the other is connected to the lead out terminal;

said copper foil flexible wire being constituted by a plurality of core wires, each of which is wound by copper foil and braided together or stranded, and impregnated with the wax according to claim 1.

* * * * *